US005279725A

United States Patent [19]

Westerman, Jr.

[11] Patent Number: 5,279,725

[45] Date of Patent: Jan. 18, 1994

[54] APPARATUS AND METHOD FOR ELECTROPLATING A WORKPIECE

[75] Inventor: Everett A. Westerman, Jr., Auburn, Wash.

[73] Assignee: The Boeing Company, Seattle, Wash.

[21] Appl. No.: 854,350

[22] Filed: Mar. 18, 1992

[51] Int. Cl.[5] ..... C25D 5/02; C25D 17/00

[52] U.S. Cl. ..... 205/88; 204/224 R

[58] Field of Search ..... 205/88; 204/224 R

[56] References Cited

U.S. PATENT DOCUMENTS 1,739,657 12/1929 Shemitz .
3,763,027 10/1973 Pearson .
3,840,455 10/1974 Cooley et al. .
4,010,005 3/1977 Morisaki et al. .
4,033,844 7/1977 Pantiga et al. .
4,132,618 1/1979 Boulanger et al. .
4,172,771 10/1979 Grunke .
4,279,706 7/1981 Blanc et al. .
4,280,884 7/1981 Babb et al. .
4,294,680 10/1981 Lincoln et al. .
4,298,446 11/1981 Ando et al. .
4,348,267 9/1982 Shimamura .
4,443,304 4/1984 Eidschun .
4,554,062 11/1985 Sergio .
4,560,460 12/1985 Blasing et al. .
4,572,768 2/1986 Wolski et al. .
4,619,741 10/1986 Minten et al. .
4,750,981 6/1988 Dalland et al. .
4,882,016 11/1989 Westerman, Jr. .
4,988,414 1/1991 Westerman, Jr. .

*Primary Examiner*—T. M. Tufariello
*Attorney, Agent, or Firm*—John C. Hammar

[57] ABSTRACT

An apparatus and method for electroplating a graphite-epoxy workpiece in-situ. An electroplating assembly includes a rigid base that is retained a fixed distance about the surface region by insulated standoff legs. A flexible vacuum bag is coupled to the graphite-epoxy workpiece with a fluid-tight seal. The vacuum bag surrounds the surface region and encloses the rigid base to form a plating chamber. A supply chamber, containing a plating fluid, is coupled to the plating chamber by a fluid-tight tubing. A storage chamber is coupled to the plating chamber by a fluid-tight tubing. A vacuum source is coupled by tubing to the supply chamber and to the storage chamber. Valves in each tubing permit the selective coupling of the vacuum source and plating chamber to either the supply chamber or the storage chamber. Electroplating is carried out while plating fluid is drawn by the vacuum, from the supply chamber into the plating chamber and into the storage chamber. When the plating fluid is nearly depleted from the supply chamber, the flow direction is reversed, to draw fluid from the storage chamber, into the plating chamber, and into the supply chamber.

23 Claims, 9 Drawing Sheets

▶ Represents a closed valve

▷ Represents an opened valve

▶ Represents a closed valve

▷ Represents an opened valve

▶ Represents a closed valve

▷ Represents an opened valve

APPARATUS AND METHOD FOR ELECTROPLATING A WORKPIECE

TECHNICAL FIELD

This invention relates to electroplating a workpiece, and more specifically, to providing an inexpensive and disposable plating apparatus and method to electroplate aircraft components.

BACKGROUND OF THE INVENTION

Certain aircraft members are often electroplated. Electroplating a copper layer onto a graphite-epoxy composite member provides conductive paths into the fibers, thus creating a spark-free composite assembly. For example, electroplating a copper layer onto fuel tank supports and rotor mounts provides lightning strike protection.

Electroplating of graphite-epoxy composite members presents particular difficulties. A graphite-epoxy composite member is constructed of conductive graphite fibers bonded together by nonconductive epoxy and has a nonconductive epoxy outer layer. Electroplating directly onto a nonconductive material, such as epoxy, is not possible because electric current must flow through the plating fluid and into the surface being plated.

A further problem is that the composite members requiring electroplating have many different shapes. For example, the composite member may be a rib section inside the wing of an aircraft or an outside, aerodynamically shaped surface. Once the member is installed on the aircraft, the surface region to be electroplated may be positioned in any orientation, including vertical and inverted. In-situ electroplating of graphite-epoxy composite members therefor presents considerable difficulties.

A capsulation system for electroplating graphite-epoxy composite members is illustrated in commonly owned U.S. Pat. No. 4,750,981, to Dalland, et al., incorporated herein by reference. In the system of Dalland et al., custom shaped hard capsules are placed over the area to be plated. Plating fluid is placed inside the container and agitated with air bubbles.

U.S. Pat. No. 4,882,016 ('016), to Westerman, commonly owned and incorporated herein by reference, describes an in-situ surface treatment containment apparatus and method. As shown in the '016 patent, a treating chamber is formed from a flexible membrane and treating fluid is drawn into the flexible membrane by a vacuum. Unfortunately, the treating membrane collapses completely against the part and an insulating member thus preventing the space between the cathode and the part from being precisely controlled. Further, an electrically insulating member directly contacts the anode and the surface region, which is undesirable during electroplating.

SUMMARY OF THE INVENTION

According to principles of the invention, a method and assembly are provided for electroplating a surface region of a graphite-epoxy workpiece. The electroplating assembly includes a rigid base that is retained a fixed distance about the surface region by insulated standoff legs. An anode is fastened to one surface of the rigid base and is electrically insulated therefrom. A flexible vacuum bag is secured to the graphite-epoxy workpiece with a fluid-tight seal. The vacuum bag surrounds the surface region and encloses the rigid base to form a plating chamber. A supply chamber containing a plating fluid is coupled to the plating chamber by fluid-tight tubing. A storage chamber is coupled the plating chamber by fluid-tight tubing. A vacuum source is coupled by tubing to the supply chamber and to the storage chamber. Valves in each tubing permit the selective coupling of the vacuum source and plating chamber to either the supply chamber or the storage chamber. An electric power source is electrically coupled by a switch to the anode and to the surface region to be plated.

The surface region of the graphite-epoxy composite workpiece is electroplated as follows. The surface region on the workpiece to be plated is prepared for plating by cleaning and applying the appropriate conductive primer. The electrically insulating standoff legs are threaded into the rigid base and the rigid base is secured to the workpiece so that the rigid base extends over the surface region to be plated. Tacky tape or some other fluid-tight sealing material is applied to the workpiece around the surface region. The vacuum bag is then placed over the sealing material on the workpiece to form a fluid-tight plating chamber. Vacuum tubing is coupled between the supply chamber and the plating chamber and between the plating chamber and the storage chamber. The vacuum source is also connected to the supply chamber and the storage chamber.

The valves in the vacuum tubing are set to create a vacuum within the storage chamber. A vacuum is then drawn on the plating chamber from the storage chamber. This vacuum draws the vacuum bag onto the base, holding it firmly in position by the suction force. The valve is then opened to permit plating fluid to enter the plating chamber from the supply chamber. The vacuum in the storage chamber draws the plating fluid from the supply chamber, into the plating chamber, and into electrical contact with the surface region to be plated. While fluid is flowing across the plating surface and into the storage chamber, an electrical current is passed through the plating fluid, from the anode to the surface region, to begin electroplating the surface region. When nearly all of the plating solution has been drawn from the supply chamber into the storage chamber, the electric power is turned off. The flow of fluid is then stopped by closing the valve from the supply chamber.

To reverse the flow direction of the plating fluid the valve from the vacuum source is set to create a vacuum within the supply chamber and from there on the plating chamber. The valve from the storage chamber is then opened and the plating fluid is drawn from the storage chamber into the plating chamber. The plating fluid is drawn from the storage chamber, across the plating surface, and into the supply chamber. While the plating fluid is flowing in the plating chamber, electric current is applied to electroplate onto the surface region.

The process is repeated from the beginning with the same plating fluid being repeatedly used by drawing the plating fluid into the plating chamber from either the supply chamber or the storage chamber. The plating continues for the time necessary to achieve the desired thickness, the plating flow being reversed as necessary to achieve the desired plating thickness. After the desired plating thickness is achieved, the process is terminated and the plating fluid is retained for later use.

A rinsing solution is then drawn from a clean water supply into the plating chamber for rinsing the surface region after plating. The vacuum bag assembly and rigid base are removed and properly disposed of.

The inventive apparatus and method provide several advantages in electroplating graphite-epoxy composite members. The rigid base is made of any expendable and inexpensive electrically insulating material, such as nylon, plastic, graphite composite material, or the like. The standoffs are made from any insulating material, such as nylon bolts.

The same plating solution is repeatedly used, until it is depleted of the plating chemical, thus saving considerable quantities of plating fluid. The supply and storage chambers can be two-gallon bottles constructed from plastic, PVC, or any common material. Because the same plating fluid is repeatedly used, the supply and storage chambers can be relatively small, one to two gallons, and need not have the 50-gallon capacity of the prior art plating fluid supply chambers.

The vacuum bag is formed from any flexible, fluid-tight material, such as mylar, plastic, nylon, a silicon sheet, or the like. Vacuum sources are readily available and can be provided in inexpensive vacuum pumps.

The entire system is therefore relatively inexpensive, portable, and can be disposed of after a single use if desired. Because the base is held in position with a vacuum source during the plating process, no through holes, clamping to the member, or fasteners are required.

Importantly, the same assembly can be used regardless of the shape or orientation of the surface region to be plated. The support can be modified to fit unique applications and contours. The legs on the rigid support can be threaded in any selected height to position the anode a selected distance from an irregular shaped surface region. The base will be held in place by the vacuum force at any orientation, including a vertical or inverted orientation. The process and apparatus can thus be used to electroplate a member in the factory during initial construction or in-situ for on-site repairs at an airfield.

DETAILED DESCRIPTION OF THE INVENTION

Figure 1A:
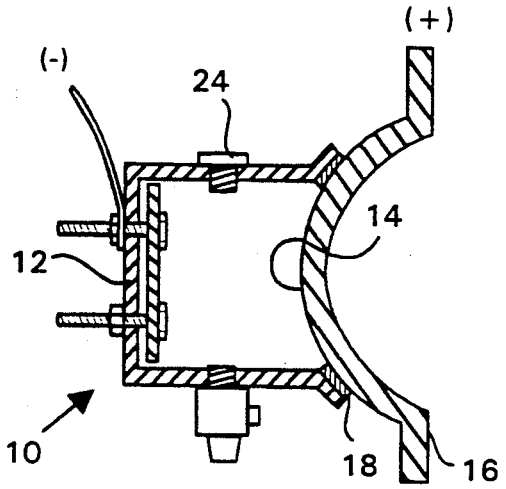
FIGS. 1A and 1B are partial cross-sectional views of a prior art plating system.
Figure 1B:
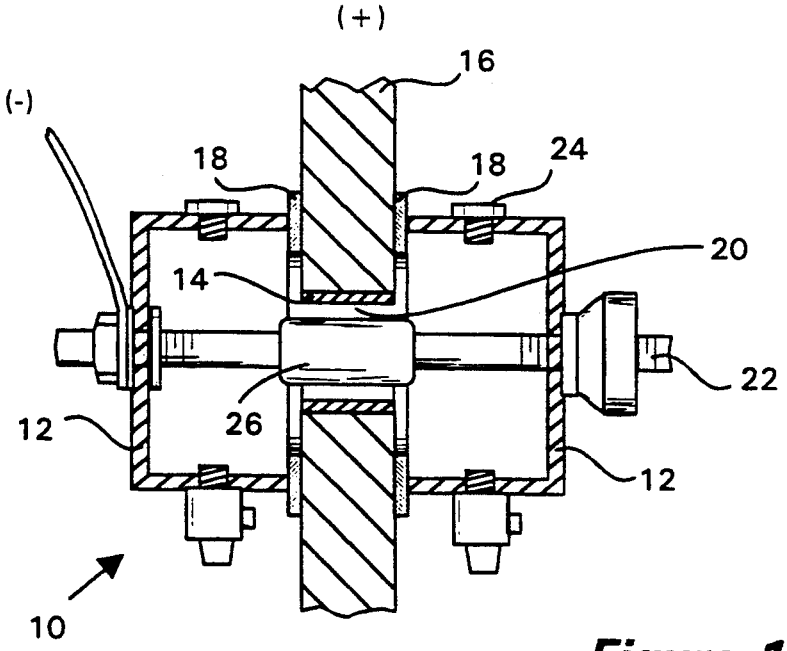

FIGS. 1A and 1B illustrate a prior-art electroplating apparatus 10 from U.S. Pat. No. 4,750,981, to Dalland et al. ('981). The '981 apparatus 10 includes a container 12 for plating a surface region 14 of a graphite-epoxy composite member 16. Custom gaskets 18 are required around the base of container 12 to seal the workpiece to the container 12. Thus, the container 12 is custom contoured to form a fluid-tight seal with the workpiece 16. Clamps, threaded fasteners, or the like for securing and strongly urging the container 12 into sealing contact with the workpiece 16 are required, though not shown in FIG. 1A (see Col. 3, lines 54–65). As stated in the '981 patent and as practiced, the container 12 is custom manufactured and contoured to engage a specific surface of each workpiece 16 to be electroplated.

FIG. 1B illustrates electroplating a different workpiece than shown in FIG. 1A, according to the prior art method of the '981 patent. Custom shaped containers 12 having a custom gasket 18 are constructed to plate a through-hole 20. A bolt 22 extending through the through-hole supports an anode 26 and provides the physical support to retain the containers 12 into fluid-tight contact with the workpiece 16. As stated in the '981 patent and practiced in the art, a plating solution is introduced into the chamber 12 via an inlet port 24. The plating solution is vigorously air agitated during the plating operation while an electric current is passed through the plating solution to plate the surface region 14 of the workpiece 16. After a desired plating thickness is formed, the electric current is removed, the plating solution is drained, and the container 12 is removed.

Figure 2:
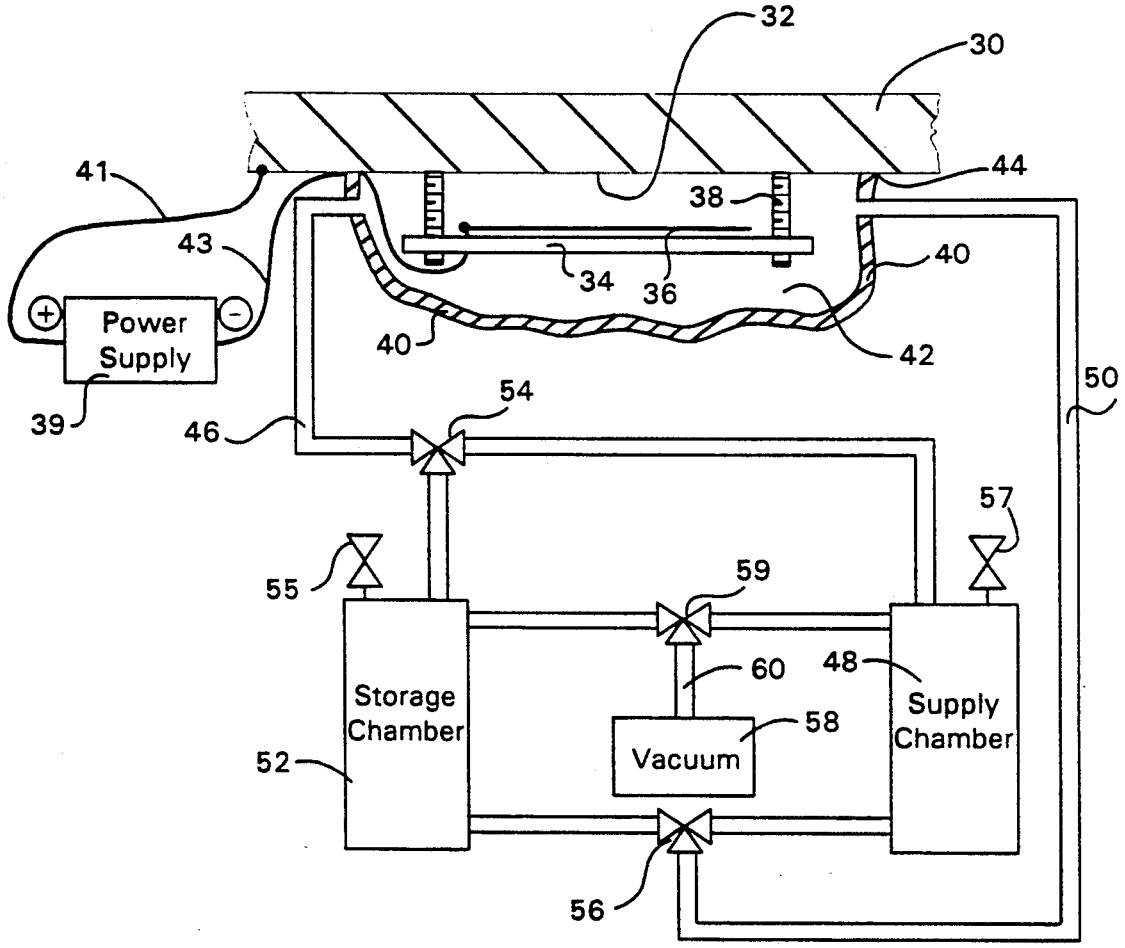
FIG. 2 is a block diagram view of the plating system according to the present invention.

FIG. 2 shows a workpiece 30 having a surface region 32 to be electroplated according to principles of the invention. An electrically insulating, rigid base 34 has an anode 36 directly coupled thereto. Any suitable attachment method is acceptable which will ensure that the anode is held firmly attached to the base 34 throughout the entire plating process. The rigid base 34 is constructed from any electrically insulating material, such as nylon, plastic, or graphite-epoxy.

Standoff legs 38 are threaded into through-holes through the base 34 to permit the height to be easily and quickly adjusted by rotating them one direction or the other until the anode 36 is a predetermined distance from the surface region 32. When the legs 38 extend to the proper height, a lock nut can be threaded into place, if desired, to keep them from rotating during the plating operation. Alternatively, the legs 38 are clamped to the base and their height can be adjusted by clamping them at any selected height. The legs can be held in position by set screws, fasteners, or the like, instead of being threaded themselves. The standoff legs 38 are constructed from nylon bolts or other suitable material.

The ease with which the height of legs 38 can be adjusted allows the same hardware base to be used with a number of plating solutions and on a variety of different shaped workpieces 30. The rigid base 34 and standoff legs 38 may be mass produced from inexpensive materials and be adjusted by the operator for each plating environment. In one embodiment, six standoff legs 38 of ¼" diameter nylon bolts extend through respective through-holes in base 34. If desired, extra through-holes may be provided to permit the nylon bolts to be threaded into alternative locations within the base 34 so that the hardware may be configured for many differently shaped workpieces 30.

A vacuum bag is placed over the base 34 and is secured to the member 30 with a fluid-tight seal 44. The fluid-tight seal 44 surrounds the surface region 32, and the vacuum bag 40 thus encloses the base 34 to form a plating chamber 42. The vacuum bag 40 is constructed from any suitable fluid-tight and flexible material. A fluid-tight nylon bag, mylar, plastic or the like are acceptable for the vacuum bag 40. Tacky tape, duct tape, sealing tape, or any other commonly available tape are acceptable for forming the fluid-tight seal 44. A silicon sheet or other cushioning material may be placed at the corners of the base 34 to ensure that the vacuum bag 40 is not punctured when a vacuum is applied that draws the vacuum bag into contact with the base 34.

Vacuum tubing 46 and 50 are coupled to the plating chamber 42 through respective ports. A supply chamber 48 filled with plating fluid and storage chamber 52 are alternatively coupled to the plating chamber 42 through a three-way valve 54 and the tubing 46. Similarly, three-way valve 56 permits either the storage chamber 52 or the supply chamber 48 to be alternatively coupled to the plating chamber 42 via the vacuum tubing 50. A vacuum source 58 is alternatively coupled via vacuum tubing 60 to either the supply chamber 48 or the storage chamber 52, depending upon the setting of three-way valve 59.

The supply chamber 48 and storage chamber 52 may be any suitable storage containers for the plating solution. Commonly available two-gallon or one-gallon noncollapsible containers constructed of plastic, PVC, or other noncorrosive material have been found suitable for use as the supply and storage chambers 48 and 52, respectively. Having large storage capacity of the supply and storage chambers is not required according to principles of the invention, and any size containers may be used as desired. A two-gallon capacity is preferred for the respective chambers because of the ease of transportation and wide availability. Two gallons of plating fluid is generally sufficient for plating a surface region according to principles of the invention. If an extremely large area is to be plated, several square feet, more plating fluid may be required and large or multiple chambers would be provided, as needed.

Figure 4:
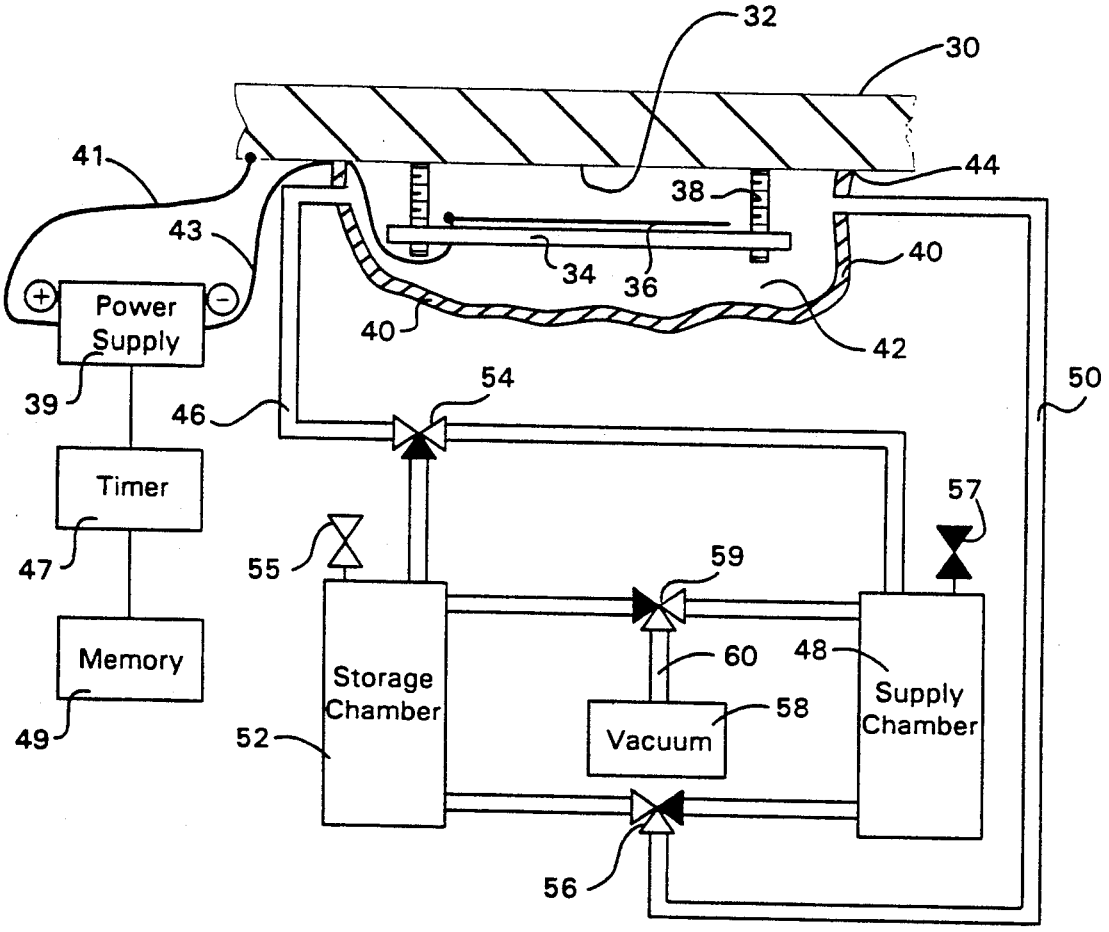
FIG. 4 is a block diagram of the plating process being carried out in the reverse mode according to principles of the invention.

In an alternative embodiment displayed in FIG. 4, a timer circuit 47 is coupled to the power on/off circuit for determining and displaying the cumulative electroplating time. In a further alternative embodiment, a memory circuit 49 is coupled to the timer circuit 47 to output the plate thickness for an elapsed time.

The operation of the preferred embodiment of the invention illustrated in FIG. 2 will be explained with reference to the flow chart of FIG. 5 and additional illustrations of the preferred embodiment in FIGS. 3 and 4 which show the preferred embodiment at different stages in the electroplating process of surface region 32.

Figure 5A:
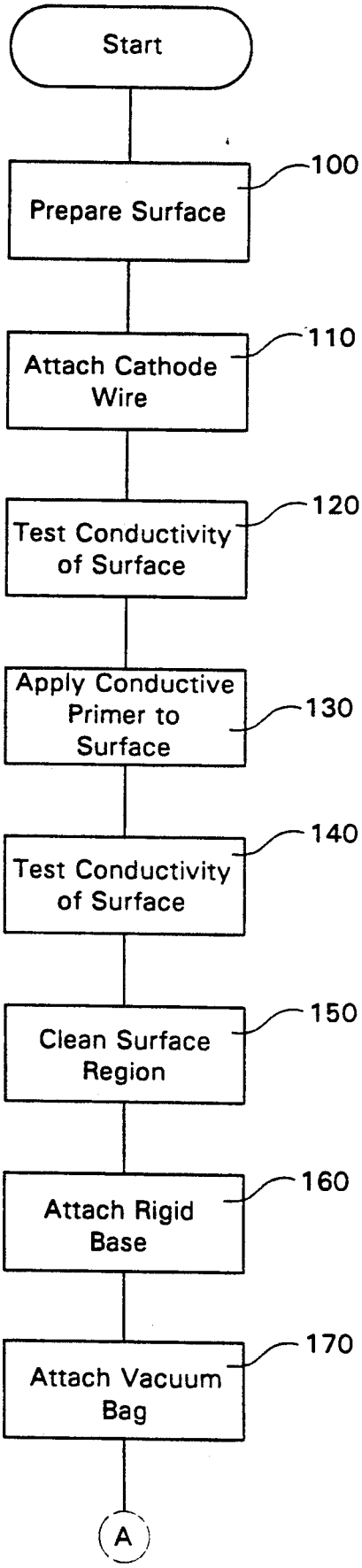
FIG. 5 is a flow chart illustrating the process flow according to principles of the invention.
Figure 5B:
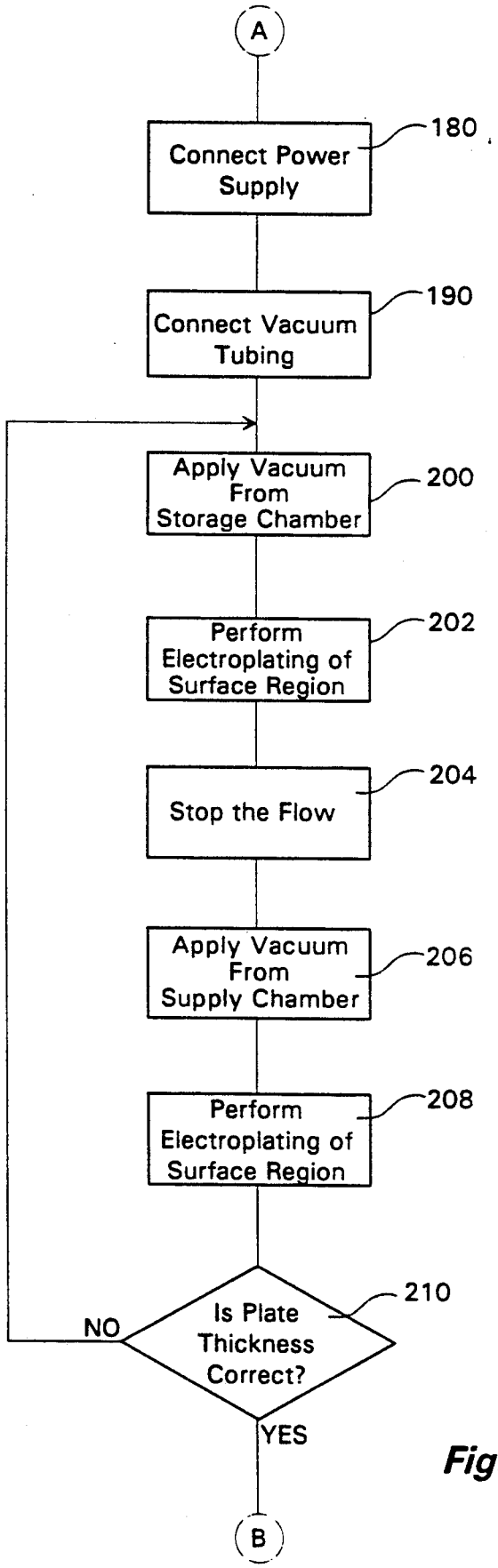
Figure 5C:
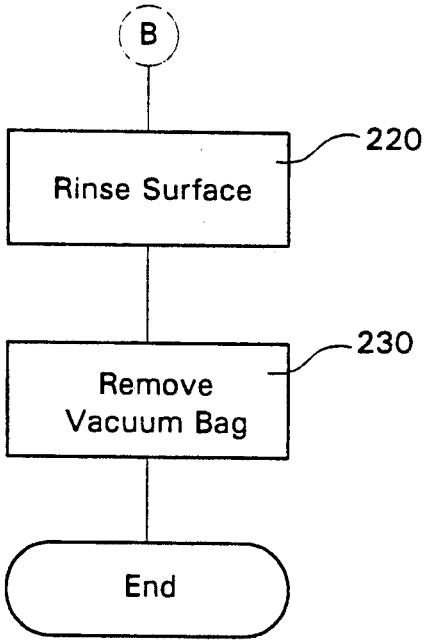

With reference to FIGS. 2 and 5, the surface region 32 of graphite-epoxy member 30 is prepared in step 100. A suitable preparation is to grit blast the graphite-epoxy member 30 with aluminum oxide grit or equivalent until the graphite fibers are exposed. Care should be taken to avoid fiber breakage. The grit blast is required to remove the outer insulating layer of epoxy and to establish electrical contact with the conductive graphite fibers in the surface region 32. The cathode wire 41 is coupled to the member 30 on the prepared surface in step 110, and the conductivity of the prepared surface is tested for continuity from the cathode wire in step 120. The resistance between the cathode wire 41 contact and the surface region 32 to be treated should be 20 ohms or less. The conductivity may also be tested by probing a sample region such as a one-inch square of the clean surface.

If additional conductivity is required, a conductive primer can be applied over the surface region to be plated at step 130, preferably in several light coats. Any conductive primer may be used, as desired. For silver-filled paint, care should be taken to ensure that the silver is well mixed in the paint for uniform conductivity. After the painted surface region 32 has dried, the resistivity is checked at step 140 to ensure that the surface resistance is less than 2 ohms. The resistance between the cathode contact and the surface region 32 to be plated is also checked to ensure that it is less than 20 ohms.

The surface region 32 is now ready for the electroplating operation. During drying, the surface region 32 may become covered with a light dust or a thin oxide barrier that must be removed at step 150 prior to electroplating. Many acceptable methods can be used to clean the surface region 32 and activate it for electroplating. An acceptable technique is a light, wet sand with a 320-grit aluminum oxide sandpaper. Care should be taken to not sand too deeply into the primer layer. A very light abrade is sufficient to remove any dirt and the oxide layer. After the final cleaning, the surface region 32 should be kept wet to rinse particles away and prevent an oxide layer from forming.

The height of the standoff legs 38 is also checked at 160 to ensure that they extend the proper height. Because the standoff legs are threaded bolts extending into through holes in the plate 34, their height can be easily adjusted by rotating the bolts to a selected height. The height of the standoff legs 38 is selected to place the anode 36 the prescribed distance from the work surface 32 to perform the electroplating operation for the given fluid and current. The height of legs 38 could be adjusted by means other than threads. For example, the legs 38 may be smooth shafts slidably coupled to the base and retained by clamps or set screws at the desired height. The effect of anode-to-workpiece spacing on plating thickness is well-known in the art for given current densities and plating fluids, and the spacing is set as prescribed in various publications.

The base 34 is held in position at step 160 by taping legs 38 to the workpiece 30 with standard duct tape, tacky tape, or the equivalent. The attachment adhesive need only be sufficiently strong to retain the base 34 in position during the mounting operation. During the actual plating operation, the vacuum suction will provide the retaining force to hold the base 34 in position.

In step 170, a fluid-tight sealing adhesive 44, such as tacky tape, is applied to the workpiece 30, and the vacuum bag 40 is attached to the workpiece 30 forming a fluid-tight seal against the adhesive 44. Slack should be left in the vacuum bag 40 to permit the vacuum bag 40 to be flexible and be compressed against the base 34. The base 34 can have a silicon sheet or other covering on the outside to prevent the corners and bolts 38 of the base 34 from tearing the vacuum bag 40. The power supply 39 is then connected between the anode through wire 43 and the cathode through wire 41 at step 180.

According to an alternative method, it may be preferred to attach the base 34 and vacuum bag 40 prior to the final surface cleaning of step 150. Because the oxide layer begins forming immediately upon exposure to air and there may be significant dust in the air, it may be desirable to wait until the last possible moment to perform the final cleaning of the surface in step 150. According to the alternative method, after the base 34 and vacuum bag 40 are attached in steps 160 and 170, a partial opening is left to permit them to be pulled aside and the surface region 32 to be cleaned a final time in step 150 and then quickly sealed to provide a clean surface region 32 surrounded by the plating chamber 42 having the base 34 enclosed therein.

As mentioned earlier, the supply chamber 48 contains a plating solution the composition of which depends upon the material to be plated onto the surface region 32. Generally, copper plating is performed in which the plating solution contains cupric sulfate, sulfuric acid, brighteners, and a small amount of hydrochloric acid. Any plating solution, such as one containing chromium, silver, or the like, may be used if desired.

Figure 3:
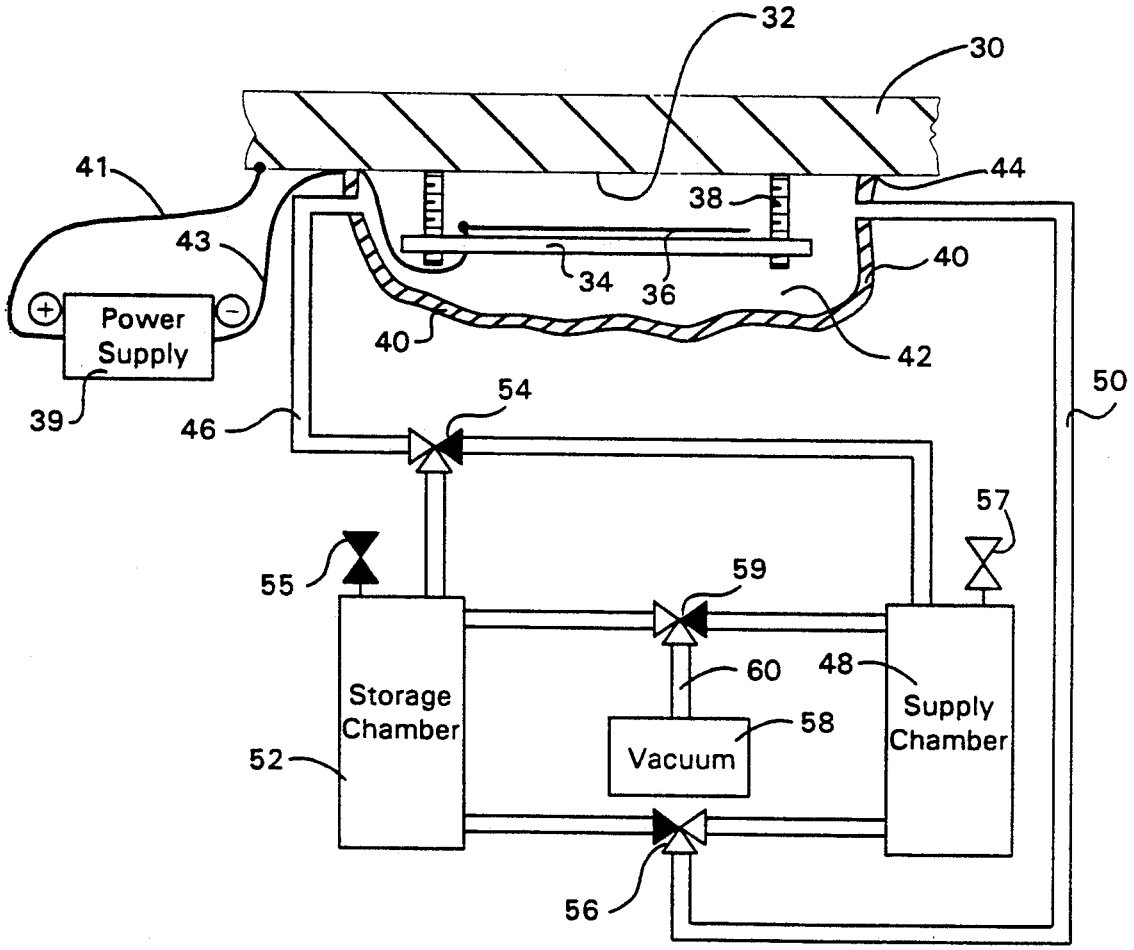
FIG. 3 is a block diagram of the plating process being carried out according to the principles of the invention.

As shown in FIGS. 3 and 5, a dark triangle indicates a closed valve and a light triangle indicates an open valve. In FIG. 3 and at step 200 of FIG. 5, valve 59 is actuated to couple the vacuum 58 to the top of storage chamber 52, and to isolate the vacuum 58 from the supply chamber 48. Valve 54 is actuated to couple the storage chamber 52 to the plating chamber 42 so that the vacuum applied to the storage chamber 52 from the vacuum source 58 is applied to the plating chamber 42 via the tubing 46. The vacuum bag 40 then collapses against the base 34 to hold the base 34 rigidly against the member 30. The standoff legs 38 and rigid base keep the vacuum bag 40 and anode 36 from collapsing completely against the surface region 32. The vacuum bag 40 therefore surrounds and encloses the base 34 but is prevented from extending under the base 34 by the standoff legs 38. The vacuum bag 40 thus forms a fluid-tight plating chamber 42 to contain the fluid but does not interfere with the electroplating process.

As further illustrated in FIG. 3 at step 200 the valve 56 is actuated to couple the supply chamber 48 to the plating chamber 42. The vacuum applied to the plating chamber 42 from the storage chamber 52 then draws plating fluid from the bottom of supply chamber 48 and into the plating chamber 42. Vent 55 on the storage chamber is closed and vent 57 on the supply chamber is open.

Electric current is passed through the plating fluid while it is in contact with and flowing over the surface region 32 to electroplate the surface region 32 at step 202 of FIG. 5. During the electroplating process it is preferred that the storage chamber remain coupled to the supply chamber 48 through the plating chamber 42 so that there is a continuous flow of plating fluid through the plating chamber 42. Although the flow rate is not critical, it should not be so high as to cause pitting, supersonic fluid flow in any of the valves, or damage to the system. Flow rate that moves one gallon of plating fluid through the plating chamber 48 into the storage chamber 52 in the range of one to two minutes has been found acceptable. For some plating fluids, high flow rates may be used such as 10 gallons per minute while for other plating fluids, a zero flow rate is preferred. Any suitable flow rate which provides a uniform plate on the surface region 32 during the plating process is acceptable.

When the supply of plating fluid in the supply chamber 48 is nearly depleted, the power supply 39 is shut off and the electroplating process is stopped at step 204. The role of the chambers 48 and 52 is then switched by actuating the three-way valves 56, 59 to cause plating fluid to pass from the storage chamber 52 through plating chamber 42 and into the supply chamber 48. The power supply is preferably turned off when the chambers are switched to guard against the surface region becoming unwetted while current is passing through. If care is taken to ensure that plating fluid completely covers the surface region 32 and extends to surround the anode 36, it may not be necessary to turn the power off when reversing the flow.

FIG. 4 shows the chambers 48 and 52 in their reversed condition. The position of valve 59 has been changed to draw a vacuum on the supply chamber 48 via tubing 60. Valve 54 is positioned to draw a vacuum on the plating chamber 42 thereby permitting the flow of plating fluid from storage chamber 52 and plating chamber 42 into the top of supply chamber 48. Electroplating is performed in step 208 by passing electric current through the plating fluid while it is flowing over and in contact with the surface region 32.

The respective tubings and valves are constructed to draw fluid from the bottom of the respective chambers 48, 52 and permit fluid to enter the chambers from the top. When either of the chambers 48, 52 are being emptied of plating fluid, their respective vents 57, 55 are opened. The vacuum tubing 60 contains the appropriate filters to keep plating fluid from fouling the vacuum source 58. The chamber containing the plating fluid is vented to the air during the plating process to ensure fluid flow. The fluid always flows the same direction across the surface region 32 being plated, even though the roles of the chambers 48 and 52 are reversed.

In an alternative embodiment, the tubings 46, 50 60 and vacuum 58 are positioned to reverse the flow direction of plating fluid across the surface region 32. Reversing the flow direction on the plating surface has the advantage of filling small holes or cracks from various angles, providing a smooth, uniform, and very flat plated layer.

The plate thickness is checked at step 210 of FIG. 5 to determine if it is correct. As is known in the art, the thickness of the plate is generally proportional to the time that electroplating is performed, if all other parameters are held constant. The process is repeated with the flow being reversed back and forth the number of times required to provide a plate of the correct thickness. For example, 1 mil plating thickness may be added for each ten minutes of electroplating operation. Depending on the plating thickness desired, plating may continue for between 20 and 60 minutes, with the flow being reversed every two to three minutes. After the plate has reached the correct thickness, the electric power is turned off and the plating fluid is drawn into one of the two chambers 48, 52.

In one embodiment, a timer circuit 47 is coupled to the electroplating power circuit 39. A clock is automatically turned on when electroplating power is applied and turned off when electroplating power is removed. When electroplating resumes, the time advances from its current time, to provide a cumulative electroplating time. The timing circuit outputs the total plating time and automatically provides an accurate measure of the exact plating time without the need for the operator to separately time the operation. The time is reset to zero at the start of each electroplating job.

In a further embodiment, a memory circuit 49 having plate thickness for a given time stored in tables therein is coupled to the timer circuit 47. Tables for various electroplating fluids and metals are stored in the memory 49. The user inputs an indication of electroplating fluid being used, or alternatively, each memory 49 is custom made for use with only one electroplating fluid. The time elapsed is output from timer circuit 47 to the memory circuit 49 and the thickness of the plate is output, thus displaying to the operator the plate thickness so the operator can stop the process at the desired thickness. Alternatively, the memory circuit 49 sends a signal to turn the values on/off as necessary. In one embodiment, the memory circuit stores a multiplier value, for example, 0.1 mil per minute of elapsed time (or 0.0017 mils per second), and multiplies the time elapsed by the selected multiplier value and outputs this value as the thickness. The memory circuit is thus, in one embodiment, merely a multiplier circuit at a preset value or gain. The plate thickness may be measured by other techniques, such as resistivity, power consumed, or the like, if desired. In a further embodiment, the operator can preprogram a selected thickness or time into the circuit and the electroplating is automatically stopped when selected thickness is reached by the time circuit 47 turning off the power from the power circuit 39.

Of course, the plating time may be checked at any time. It is expected that the plating time would be constantly monitored and the process stopped when the correct plate thickness is reached. The correct plate thickness may be reached when the storage chamber is only partially filled or any time in the process. The electroplating is stopped by turning off the current at the desired time. The plating fluid may then be drawn, by vacuum 58, into the desired chamber 48 or 52 for storage and retained.

Switching the roles of the chambers to provide a reversible flow configuration has significant advantages. A plating fluid is not completely depleted of plating material with a single use. Therefore, the same plating fluid can be used a number of times, a percentage of the plating material being removed each time. The reversible flow process permits a closed system to be used and only a small amount of plating fluid. One or two gallons of plating fluid, if repeatedly passed over the surface region, contains sufficient plating material for most applications. Two gallon supply and storage chambers are sufficiently compact that they may be easily transported to any desired location. Significant acquisition and disposal cost savings are realized by using small containers and only a small amount of fluid. If a new supply of fluid were constantly provided, 20 to 50 gallons might be required, thereby requiring 50-gallon containers for the supply chamber 48 and the storage chamber 52, respectively. If an extremely thick plate is desired, it may be necessary to provide a new plating solution to ensure that sufficient plating material remains within the solution. However, for most applications, one to two gallons of plating solution, repeatedly used, will retain sufficient plating material to provide the desired thickness.

As shown in FIG. 5, the surface region 32 is rinsed with the plating chamber in position at step 220, although this may not be required. Rinsing is carried out by connecting a rinse solution to vacuum tubing 50 and drawing a vacuum on the plating chamber. According to a preferred embodiment, tap water is attached to the vacuum tubing 50 and a gallon of water is drawn through the plating chamber 42 to provide the rinse. The rinse solution is properly disposed of, taking into consideration environmental concerns.

After the rinse has been completed, the vacuum bag 40, fluid-tight seals 44, and base 34 are removed and properly disposed of, again, taking into consideration environmental concerns. If desired, the same hardware may be used for additional plating jobs if it is not contaminated.

Electroplating while the plating fluid is under a vacuum has numerous advantageous over positive pressure systems. The vacuum bag 40 is collapsed against all surfaces except that protected by the rigid base 34, thereby minimizing the required volume of plating solution. Also, the use of a vacuum makes the location of seal 44 less critical so that a high level of operator skill to provide close tolerances is not required.

Another advantage to using a vacuum is that the vacuum holds the anode 36 and base 34 in position against the workpiece 30, whereas a pressure system would tend to push them away. The requirement to use other clamps, fasteners and the like is thereby avoided.

Figure 6:
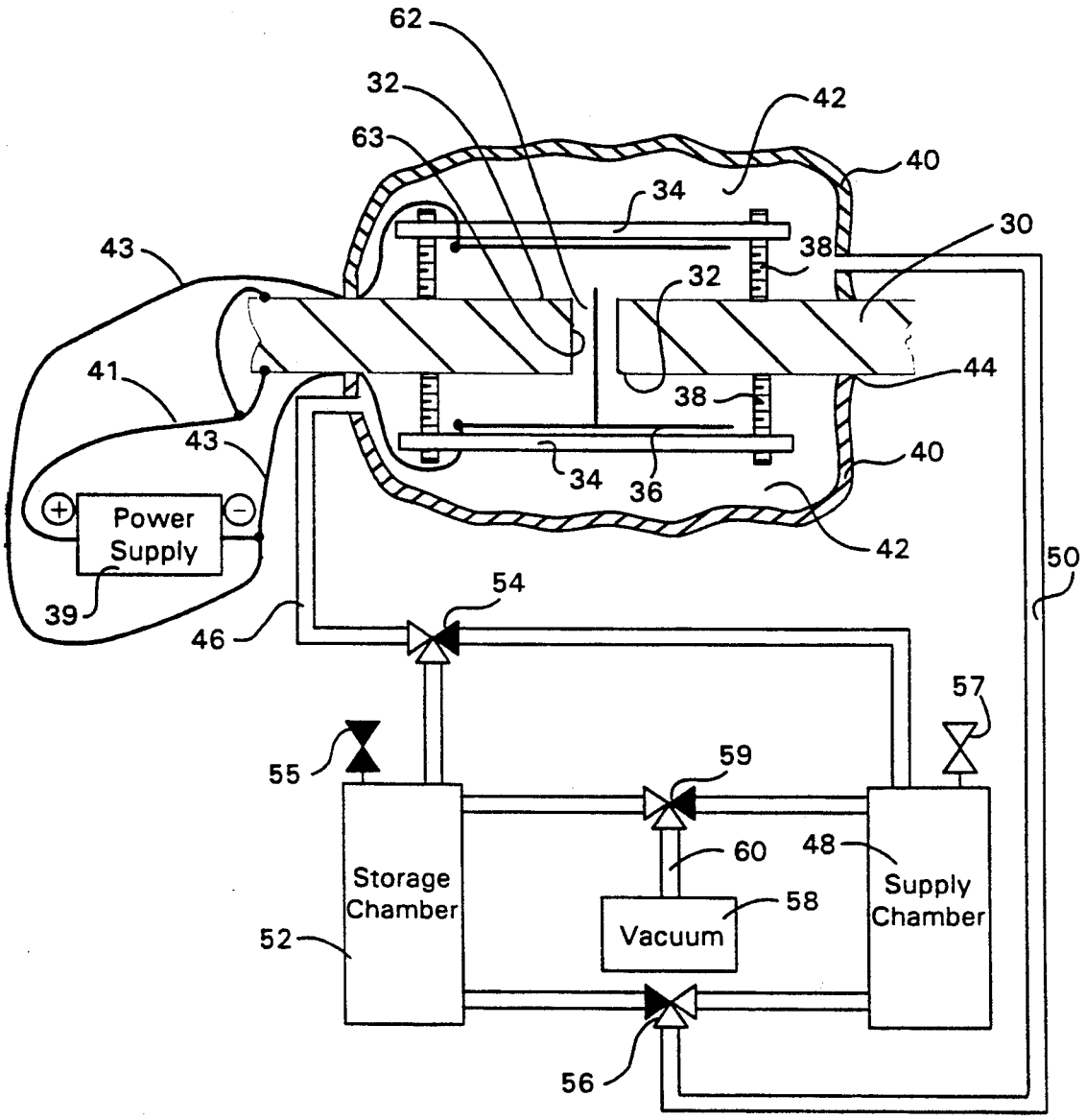
FIG. 6 is a combination partial cross-sectional view and block diagram of an alternative embodiment for electroplating a workpiece having a through-hole.

FIG. 6 illustrates the method and apparatus according to the invention carried out on a workpiece 30 having a through-hole 62. Generally, it is desirable to plate the inside of the through-hole 62 and also plate the surface region 32 immediately surrounding the through-hole 62. The structure and method of the invention have been found suitable for plating a through-hole 62 simultaneous with plating the surface region 32.

As shown in FIG. 6, a plating chamber 42 is formed by placing vacuum bag 40 on each side of the workpiece 30 as previously described with respect to FIG. 5, thereby forming a large plating chamber 42. Respective bases 34 are positioned on each side of the workpiece 30 having respective standoffs 38. The tubing 50 is coupled to one side of the plating chamber 42, and the tubing 46 is connected to the other side of the plating chamber 42. The anode 36 extends into the through-hole 62. In one embodiment, the anode 36 contains a rod extending perpendicular to the base 34 and into the through-hole 62 to provide a uniform current density across all regions being plated. When the vacuum is applied, electroplating fluid passes across the surface region 32 and through the through-hole 62 during the plating process. The process is carried out as described with respect to FIGS. 3, 4, and 5 to electroplate the workpiece 30 as needed.

Tests have shown that a smooth, integral layer is electroplated on the inside surface 63 of the through-hole 62 simultaneously with plating an even layer on the surface region 32. In graphite-epoxy composite material, the through-hole 62 includes exposed ends of conductive graphite fibers. These fibers and the surrounding surface are thus plated with a continuous integral copper plate from each surface region 32 to the ends of the graphite fibers on surfaces of through-hole 62. In the event of a lightning strike adjacent through-hole 62, electric current is conducted along the plated surface region 32 and into the integral, continuous plated region 63 within the through-hole 62, and then into the ends of the graphite fibers. Electric current is prevented from passing into the workpiece 30 through the matrix of nonconductive epoxy and conductive graphite. An effective lightning shield is thus provided to prevent arcing and avoid possible destruction of a fuel tank.

Figure 7:
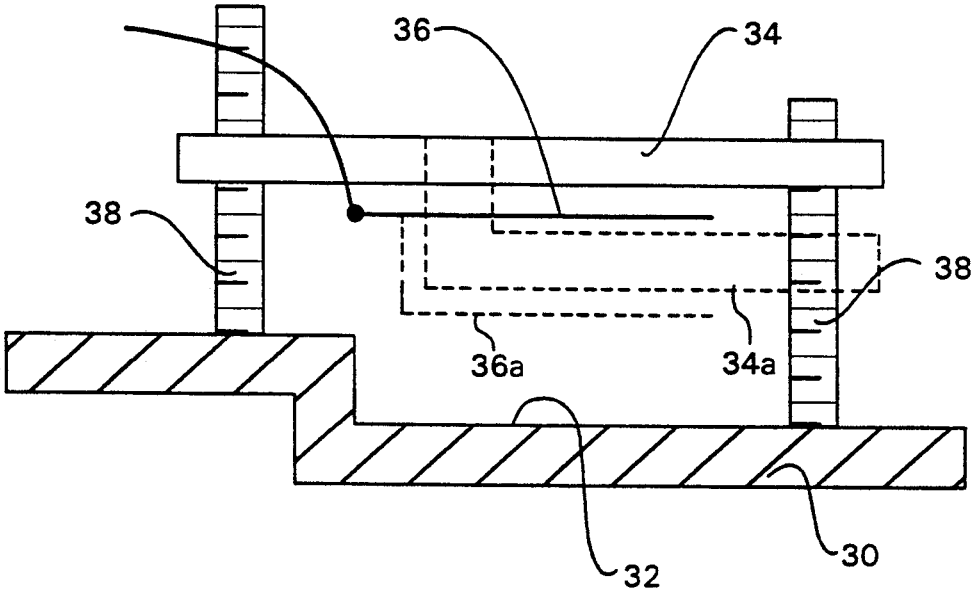
FIG. 7 is a partial cross-sectional view of an alternative embodiment for electroplating a workpiece having an irregular shape.

FIG. 7 illustrates, in simplified form, the inventive process being carried out on a non flat workpiece 62. It is well known that the distance of the plating anode to the plating surface is a key parameter in electroplating processes generally. According to principles of the invention, the height of the standoff legs 38 is selected to provide the precisely called for distance, based on known anode-to-workpiece spacing requirements.

In FIG. 7, the workpiece 30 has an irregular shape at or adjacent the surface region 32. Accordingly, one or more of the standoff legs 38 are threaded to extend a different height than other standoff legs. The appropriate height for each leg 38 is selected to retain the anode 36 in the desired position with respect to the workpiece 30. For a slightly sloping surface or a curved surface of workpiece 30, each leg is appropriately threaded to the desired height to hold the anode 36 in the correct relationship to the surface region 32. Different length bolts for legs 38 can be provided if necessary. Custom sealing gaskets and a chamber for each different site are not required, because the vacuum bag 40 can be configured to seal to any surface. Custom containers are also not required.

The anode is also configurable to different shapes, if necessary. Shown in dotted lines in FIG. 7 is a rigid base 34*a* that is angled and an anode 36*a* coupled to the base 34*a*, following the contour of the base 34*a*.

The inventive method and apparatus has been described with respect to a particular embodiment. It will be understood that the same method and apparatus may be applied to numerous workpieces and is not restricted to aircraft parts. For example, the method apparatus may be used to plate, or etch, or deposit to, a surface region any conductive or nonconductive member, including automobiles, computers, circuit boards, and the like. Any plating fluid could be formed, to plate with any material, including silver, gold, chrome, or the like.

Advantageously, the inventive apparatus and method may be used to electroplate an antenna pattern onto a graphite-epoxy composite member. A radio antenna element pattern electroplated according to principles of the invention would have the advantage of being a void-free, metal layer that is smooth and can be placed on any part of the aircraft.

Numerous structures and method steps which are equivalent to those disclosed herein may be substituted to provide an equivalent apparatus and process which fall within the scope of the invention. From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. An apparatus for plating a surface region of a workpiece, comprising:
- an electrically nonconductive base adapted to be coupled to said workpiece and retained a selected distance from said workpiece;
- an anode rigidly coupled to said base;
- a plurality of standoff legs coupled to said base, said standoff legs being adapted to be attached to said workpiece and having a selected height to retain said base a selected distance from said surface region;
- a fluid-tight plating chamber coupled with a fluid-tight seal to said workpiece and enclosing said base;
- a supply chamber coupled to said plating chamber and having a plating fluid therein for supplying said plating fluid to said plating chamber;
- a fluid-tight tubing selectively coupling said supply chamber to said plating chamber;
- a vacuum source that is coupleable to said supply chamber for drawing said plating fluid from said supply chamber and into said plating chamber; and
- an electric power supply electrically coupled to said anode and to said surface region to electroplate said surface region.

2. The apparatus according to claim 1, further including:
- a storage chamber coupled to said plating chamber with a fluid tight coupling; and
- a vacuum source tubing coupled to said storage chamber, said vacuum source tubing being coupleable to said vacuum source to draw plating fluid from said plating chamber and into said storage chamber.

3. The apparatus according to claim 1, further including:
- a tubing between said vacuum source and said supply chamber;
- a tubing between said vacuum source and said storage chamber; and
- valve means for selectively coupling said vacuum source to said supply chamber or to said storage chamber.

4. The apparatus according to claim 1 wherein said fluid-tight plating chamber includes a flexible membrane and said vacuum source provides a force to draw said flexible membrane into abutting contact with said base and to retain said base in a fixed relationship with respect to said surface region.

5. The apparatus according to claim 1 wherein said standoff legs are threadably coupled to said base and said selected height is adjustable by an operator by threading said standoff legs a selected distance into said base.

6. The apparatus according to claim 1 wherein said base is constructed from a disposable, graphite-epoxy panel.

7. The apparatus according to claim 1 wherein said base is a constructed from a disposable, rigid base molded from a plastic material.

8. The apparatus according to claim 1 wherein said workpiece includes a through-hole, and further including a plating assembly affixed to a second side of said workpiece, comprising:
- a second electrically nonconductive base;
- a second anode rigidly coupled to said base;
- a second plurality of nonconductive standoff legs coupled to said base, said second plurality of standoff legs having a selected height;
- a second fluid-tight plating chamber coupled with a fluid-tight seal to said second side of said workpiece; and
- a fluid-tight tubing selectively coupling said supply chamber to said second fluid-tight plating chamber to require fluid to pass from said second plating chamber and into said first plating chamber via said through-hole for plating an inside surface of said through-hole.

9. The apparatus according to claim 1 wherein at least two of said standoff legs have the same height as each other to position the anode a selected distance from the respective surfaces to which said standoff legs are attached.

10. The apparatus according to claim 1 wherein at least two of said standoff legs have different heights from each other to position said anode a selected distance from said surface region to be plated but a different distance from each of the two surfaces to which said two respective legs are attached.

11. The apparatus according to claim 1, further including:
- a timer circuit coupled to said electric power supply, the timer circuit advancing the time on a timer when electroplating power is being applied to the workpiece and maintaining the time at its then current value when electroplating power is not applied to the workpiece and outputting the cumulative electroplating time.

12. The apparatus according to claim 1, further including:

a memory circuit coupled to the timer circuit, the memory circuit having an expected plate thickness for a selected time stored therein and outputting the approximate plate thickness based on the electroplating time as output by the timer circuit.

13. A method of plating a surface region of a workpiece, comprising:

positioning an anode a selected distance above said surface region;

forming a fluid-tight plating chamber around said surface region and enclosing said anode;

coupling a supply chamber containing a plating fluid to said plating chamber;

coupling a storage chamber for receiving said plating fluid, to said plating chamber;

forming a fluid-tight connection between a supply chamber containing a plating fluid, said plating chamber, and a storage chamber for receiving said plating fluid;

introducing plating solution into said plating chamber by drawing a vacuum within said storage chamber to draw plating fluid into said plating chamber from said supply chamber, and in contact with said surface region and into said storage chamber; and electroplating the surface region by passing an electric current from said anode, through said plating fluid, and into said surface region while said plating fluid is in contact with said surface region.

14. The method according to claim 13 further including the steps of:

advancing a time of a timer circuit while electroplating power is supplied to the surface region, the timer circuit coupled to a power source providing power to perform the electroplating; and maintaining the time of the timer circuit at its then current value when electroplating power is not applied so that the time of the timer circuit is the cumulative electroplating time.

15. The method according to claim 14 further including the steps of:

multiplying the electroplating time of the timer circuit by a selected value based on the approximate change in plate thickness over time; and outputting the appropriate plate thickness of the plate being formed.

16. The method according to claim 13, further including the steps of:

stopping the flow fluid from said supply chamber into said storage chamber;

creating a vacuum within said supply chamber, said vacuum causing said plating chamber to collapse against said base and provide a force to hold it in a fixed relationship with respect to said surface region during said plating process;

drawing said plating fluid from said storage chamber through said plating chamber and in contact with said surface region and into said supply chamber;

retaining said anode said selected distance from said surface region while electric current is passed through said anode by said plating chamber collapsing because of said vacuum and retaining said anode in position by vacuum force;

passing an electric current from said anode, through said plating fluid and into said surface region while said plating fluid is in contact with said surface region; and stopping the flow fluid from said storage chamber into said supply chamber.

17. The method according to claim 16 wherein said stopping and said drawing steps are repeated a plurality of times until said plated material reaches a selected thickness.

18. The method according to claim 13 wherein said step of positioning said anode includes:

attaching a rigid base to said workpiece, said rigid base having said anode attached thereto and positioned to support said anode said selected distance above said surface region.

19. The method according to claim 18 wherein said attaching step includes:

threading a first standoff leg a first distance into said base said first standoff leg to extend a first selected height from said base; and threading a second standoff leg a second distance into said base to cause said second standoff leg to extend a second selected height from said base, said second selected height being less than said first selected height.

20. The method according to claim 13 wherein said surface region is an electrical insulator and further including the steps of:

cleaning the surface of said workpiece over an area larger than said surface region; and applying a conductive layer to said surface region.

21. The method according to claim 13 wherein said step of forming a fluid-tight plating chamber includes the step of:

attaching a flexible membrane to said workpiece with a fluid-tight seal, said flexible membrane enclosing said rigid base workpiece to form said plating chamber; and placing a vacuum source on said flexible membrane prior to introducing said plating fluid into said plating chamber, said vacuum source collapsing said flexible membrane against said base to retain said base in a fixed relationship with respect to said workpiece.

22. The method according to claim 13 wherein said workpiece is a graphite composite workpiece having an insulating outer layer and a more conductive inner layer, and further including the steps of:

abrading an outer surface of said composite surface to expose a surface region having a higher conductivity than said outer layer;

testing the resistivity of said exposed surface region to ensure that it is below a threshold level;

applying a conductive layer of primer to said exposed surface region; and testing the resistivity of said conductive primer on said surface region to ensure that it is below a threshold level.

23. The method according to claim 13, further including:

maintaining a constant flow of plating fluid from said supply chamber, across said surface region and to said storage chamber while an electric current is passing through said plating fluid for at least a portion of the plating process.

* * * * *